US011885203B1

(12) United States Patent
Greci et al.

(10) Patent No.: US 11,885,203 B1
(45) Date of Patent: Jan. 30, 2024

(54) WELLBORE CASING SCRAPER

(71) Applicant: Halliburton Energy Services, Inc., Houston, TX (US)

(72) Inventors: Stephen Michael Greci, Carrollton, TX (US); Michael Linley Fripp, Singapore (SG); Finn Gamble McCarthy, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/877,681

(22) Filed: Jul. 29, 2022

(51) Int. Cl.
*E21B 37/04* (2006.01)

(52) U.S. Cl.
CPC ..... *E21B 37/04* (2013.01)

(58) Field of Classification Search
CPC ..... E21B 37/00; E21B 37/02; E21B 37/04; E21B 37/045; E21B 37/08
See application file for complete search history.

(56) References Cited

U.S. PATENT DOCUMENTS 2,710,657 A * 6/1955 Scivally ..... E21B 37/02 166/173
4,580,635 A * 4/1986 Radford ..... E21B 37/02 166/170
6,152,221 A * 11/2000 Carmichael ..... E21B 37/02 166/174
8,002,037 B2 8/2011 Booth
8,464,812 B2 6/2013 Radford et al.
9,045,970 B1 * 6/2015 Riley, Jr. ..... E21B 47/01
10,119,368 B2 11/2018 Tunget
10,132,139 B1 11/2018 Robert et al.
10,267,111 B2 4/2019 Tart et al.
11,566,492 B1 * 1/2023 Maher ..... E21B 23/006
2008/0010765 A1 1/2008 Booth
(Continued)

FOREIGN PATENT DOCUMENTS

CN 106285563 B 8/2019
EP 2212514 A2 8/2010
(Continued)

OTHER PUBLICATIONS

International Search Report and Written Opinion dated Apr. 19, 2023; International Application No. PCT/US2022/039078.
(Continued)

*Primary Examiner* — David Carroll
(74) *Attorney, Agent, or Firm* — Barnes & Thornburg, LLP

(57) ABSTRACT

A controllable downhole scraper includes a fluid reservoir having a pressure wall positioned and movable within the fluid reservoir defining a first portion of the fluid reservoir including a first fluid. The pressure wall exerts a force on the first fluid to maintain a first pressure. A scraper blade is movable between a retracted and an extended position. A sleeve is positioned on a tubular and slidable between a first position engaging the scraper blade to move into the retracted position, and a second position engaging the scraper blade to move into the extended position. The sleeve is configured to move between the two positions through a reduction in the first pressure in the first fluid. A restrictor is fluidly coupled between the fluid reservoir and a pressure reservoir. A gas reservoir, fluidly coupled to the first fluid, is selectively operable to reduce the first pressure in the first fluid.

20 Claims, 4 Drawing Sheets

(56) References Cited

U.S. PATENT DOCUMENTS

| | | | | |
|---|---|---|---|---|
| 2009/0025927 | A1 | 1/2009 | Telfer | |
| 2016/0138369 | A1* | 5/2016 | Tunget | E21B 37/02 166/174 |
| 2016/0312582 | A1* | 10/2016 | Ali | E21B 37/02 |
| 2017/0058612 | A1* | 3/2017 | Adams | E21B 10/322 |
| 2018/0202269 | A1* | 7/2018 | Wensrich | E21B 34/14 |
| 2019/0169955 | A1* | 6/2019 | Knight | E21B 37/045 |
| 2020/0080400 | A1 | 3/2020 | Garcia | |
| 2021/0285306 | A1* | 9/2021 | Al Mulhem | E21B 33/10 |

FOREIGN PATENT DOCUMENTS

| | | | |
|---|---|---|---|
| EP | 2635384 | A1 | 9/2013 |
| WO | 2001066907 | A1 | 9/2001 |
| WO | 2020208327 | A1 | 10/2020 |

OTHER PUBLICATIONS

Weatherford, "Enabling effective completions through mechanical and chemical wellbore cleaning", Wellbore Cleaning Services, 2016, pp. 1-48.

* cited by examiner

WELLBORE CASING SCRAPER

TECHNICAL FIELD

The present disclosure relates generally to downhole scrapers, and, more particularly, to a downhole scraper for removing debris from an inner surface of a wellbore casing or other tubular.

BACKGROUND

A casing is provided in a wellbore to isolate different zones in the drilled formation, to provide a strong upper foundation for the drilling fluid, and to provide a smooth internal bore for installing production equipment. During the cementing process in a wellbore casing, cement slurry is first pumped down the internal bore of the casing and then displaced using another fluid, typically mud, from the lower end of the casing and up into the annular space between the casing and the rock formation. Some of the cement slurry blocks useful perforations and adhere to the internal wall of the casing. In particular, when liners are used in casings, slurry accumulates at the step change in internal diameter at the top of the liners.

The particles of cement and other debris which arise from the scraping operation are removed later, by circulating well fluid such as drilling mud or brine through the well. Typical scraper tools comprise a cylindrical body and a number of scraping blades, typically spring-loaded and extending from the cylindrical body. As the scraper tool travels upward or downward, the extended scraping blades contact the casing wall and clean the casing wall by dislodging the debris accumulated thereon.

Scraping blades are not typically retractable. The blades may hit or run through restrictions during upward or downward motions of the scraping tools and can cause damage to, or bending of, the blades which impairs performance.

BRIEF DESCRIPTION OF THE DRAWINGS

Illustrative examples of the present disclosure are described in detail below with reference to the attached drawing figures, which are incorporated by reference herein, and wherein.

Figure 1:
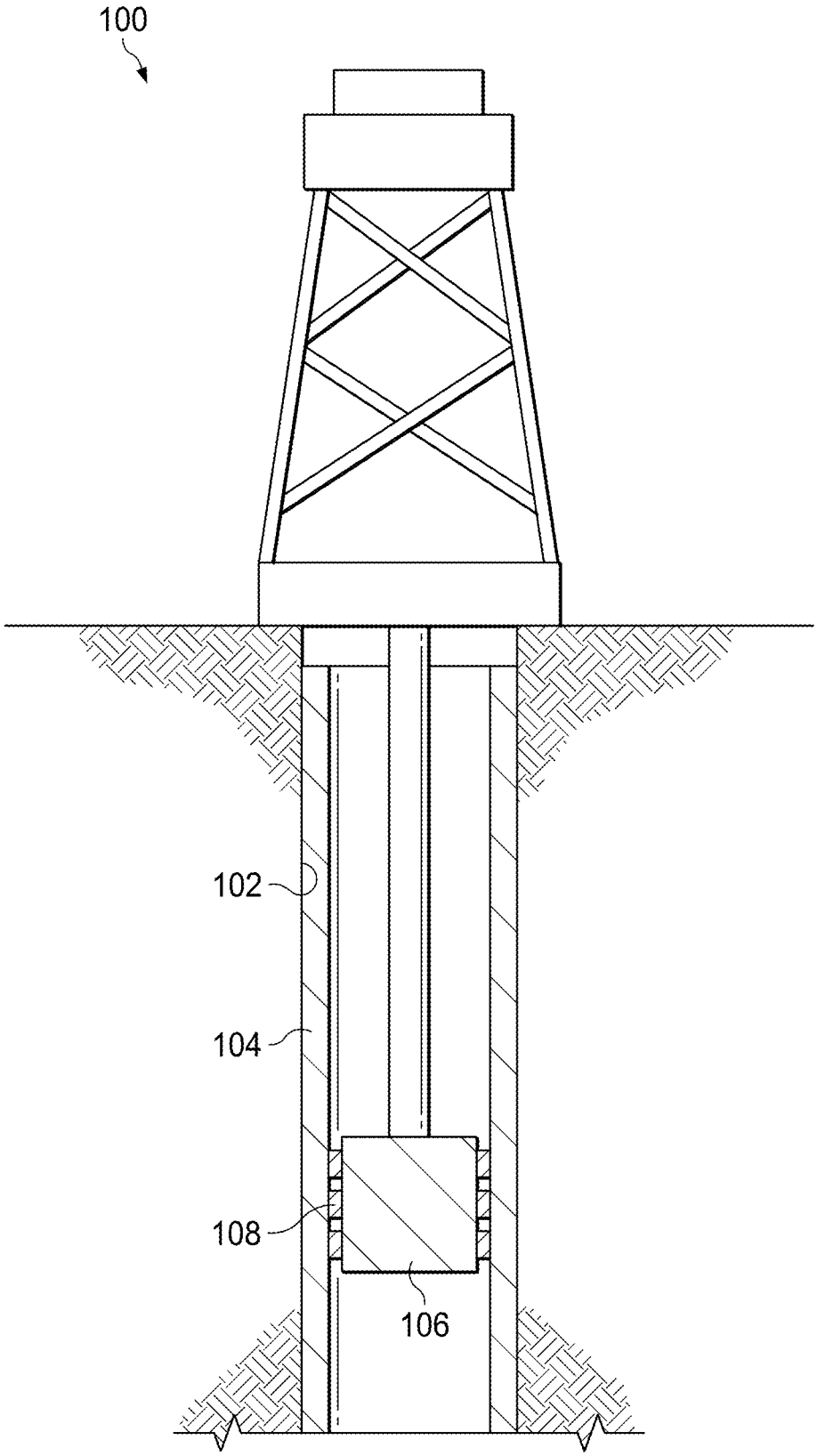
FIG. 1 illustrates a cross-sectional view of a downhole cleaning tool for a wellbore.

The illustrated figures are only exemplary and are not intended to assert or imply any limitation with regard to the environment, architecture, design, or process in which different examples may be implemented.

DETAILED DESCRIPTION

The present disclosure relates generally to wellbore operations, and more particularly, to the use of a controllable downhole scraper for removing debris from an inner surface of a wellbore casing or tubular.

In the following detailed description of several illustrative examples, reference is made to the accompanying drawings that form a part hereof, and in which is shown by way of illustration, examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples is defined only by the appended claims.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

The examples described herein relate to the use of a controllable downhole scraper for removing debris from an inner surface of a wellbore casing or tubular. The controllable downhole scraper comprises a fluid reservoir having a pressure wall positioned and movable within the fluid reservoir to define a first portion and a second portion of the fluid reservoir. The first portion includes a first fluid, and the pressure wall exerts a force on the first fluid to maintain a first pressure. The controllable downhole scraper also includes a scraper blade movable between a retracted position and an extended position. The controllable downhole scraper further includes a sleeve positioned on a tubular and slidable between a first position and a second position. Advantageously, the sleeve in the first position engages the scraper blade to moves the scraper blade into the retracted position. Conversely, the sleeve in the second position engages the scraper blade to moves the scraper blade into the extended position. The sleeve is configured to move between the retracted position and the extended position through a reduction in the first pressure in the first fluid. A restrictor is fluidly coupled between the fluid reservoir and a pressure reservoir. Further, a gas reservoir is fluidly coupled to the first fluid. The gas reservoir is selectively operable to reduce the pressure of the first fluid.

The gas reservoir is controllable to open upon receiving a control signal and thereby to receive a first portion of the first fluid from the fluid reservoir. In one aspect, the pressure reservoir includes a chamber defined between the sleeve and the tubular. The chamber is fluidly coupled to the first portion of the fluid reservoir and configured to receive a part of a second portion of the first fluid from the fluid reservoir. The chamber is adjustable between an expanded state and a collapsed state. Advantageously, the collapsed state of the chamber corresponds to a reduction of pressure in the chamber caused by the burst of the gas reservoir. Conversely, the expanded state of the chamber corresponds to a restoration of pressure in the chamber caused by a part of the second part of the first fluid received in the chamber. The collapsed state of the chamber further corresponds to the extended position of the scraper blade and the expanded state of the chamber further corresponds to the retracted position of the scraper blade. The scraper blade, in its extended state, cleans or removes the debris from the inner surface of the wellbore casing.

FIG. 1 is an illustrative view of a downhole cleaning tool system 100 for a wellbore 102. Referring to FIG. 1, the wellbore 102 includes a wellbore casing 104 and a wellbore cleaning tool 106. Operation of the downhole cleaning tool system 100 generally includes running the cleaning tool 106 downhole and uphole into the casing 104. The wellbore cleaning tool 106 includes one or more exemplary scraper blades 108. As explained in more detail below, the scraper blades 108 are controllable to extend out from the cleaning tool 106 and then, after the passage of a scraping time, to retract back to their default position within the cleaning tool 106. The scraper blades 108, in their extended state during the scraping time, scrape or clean the inner surface of the wellbore casing 104 by dislodging the debris accumulated on the casing 104.

Figure 2:
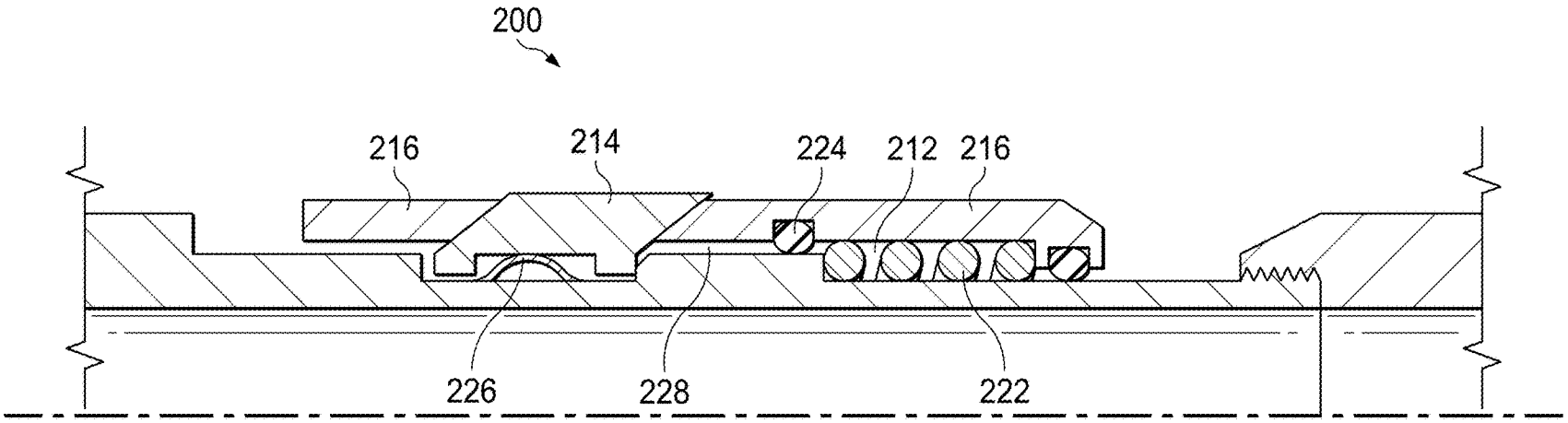
FIG. 2 illustrates a cross-sectional view of a chamber of the downhole cleaning tool of FIG. 1, in an expanded state.
Figure 4:
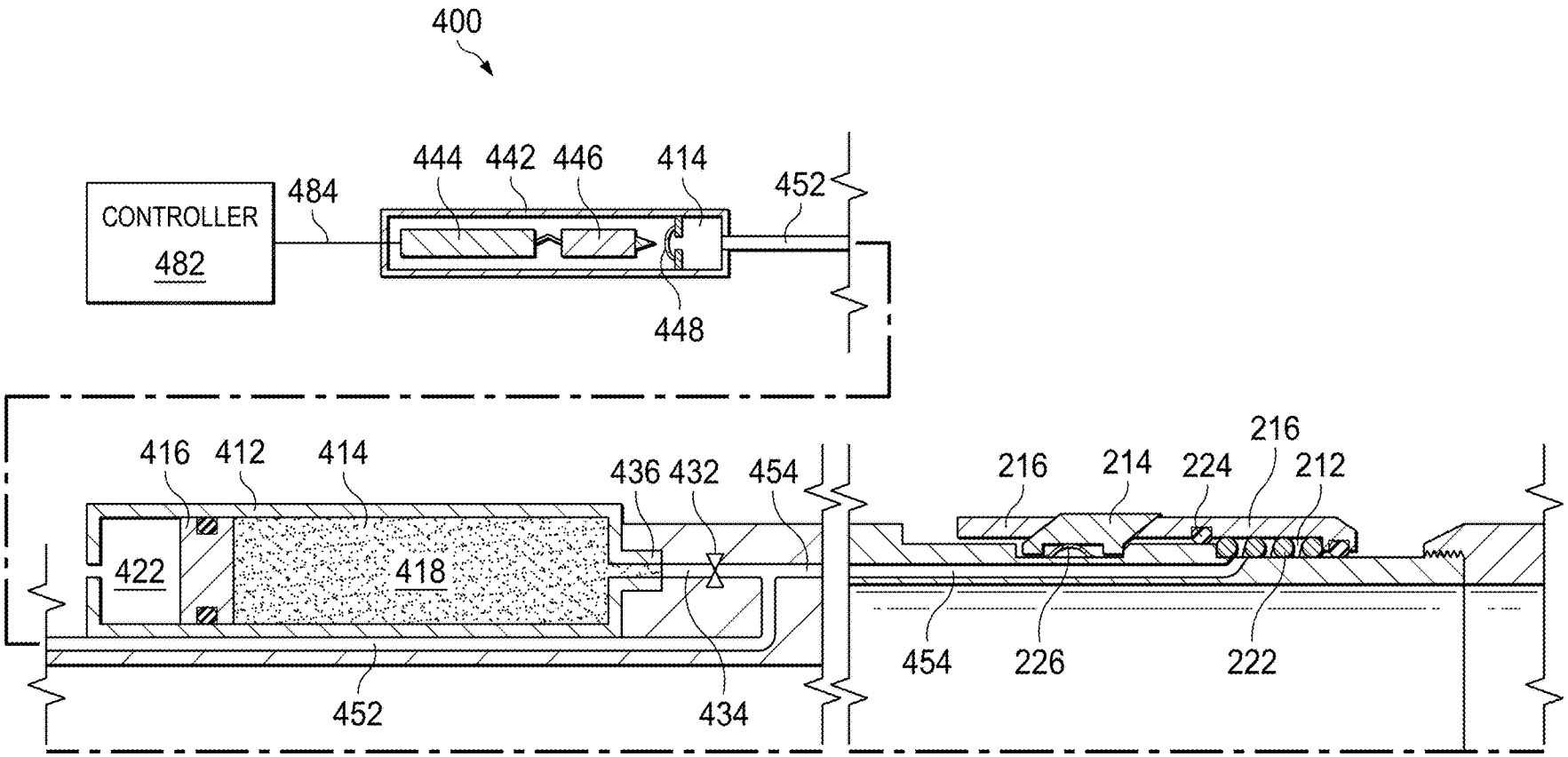
FIG. 4 illustrates a cross-sectional view of a plumbing schematic of the downhole cleaning tool of FIG. 1.
Figure 5:
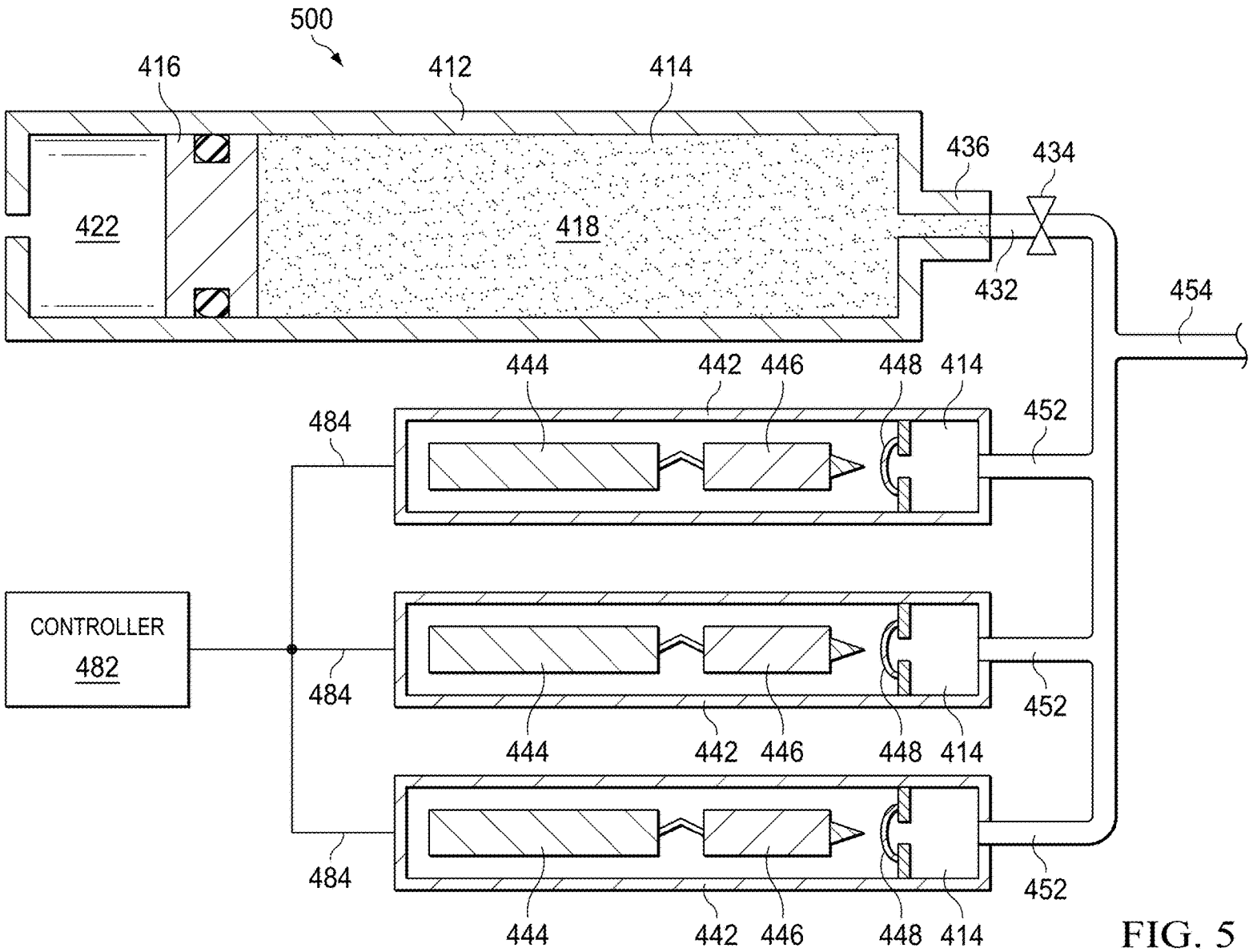
FIG. 5 illustrates a cross-sectional view of a detailed plumbing schematic of the downhole cleaning tool of FIG. 1.

FIG. 2 is an illustrative cross-sectional view of an exemplary scraper blade 214, illustrated in a representative retracted condition. Referring to FIG. 2, a scraping tool 200 includes a pressure reservoir. In one aspect, the pressure reservoir is a hydrostatic chamber (referred to as "chamber") 212 that is fluidly coupled to a fluid reservoir (will be described in more details later, in FIGS. 4 and 5) through a fluid communication line (FIGS. 4 and 5). The chamber 212 is configured to receive a stream of fluid (e.g., clean oil) flowing out from the fluid reservoir. The flow of the fluid (e.g., clean oil) into and out of the chamber 212 causes the chamber 212 to adjust, respectively, between an expanded state and a collapsed state by a mechanism described below.

The chamber 212 of FIG. 2 is in an exemplary expanded state. The chamber 212 includes an exemplary compression spring 222, an exemplary seal 224, and a fluid communication line 228. The compression spring 222 and seal 224 are made of spring-steel or any other material suitable for engineering applications involving expansion and contraction of constituent parts. There are four coils in compression spring 222 and one seal 224 shown in FIG. 2. The number of compression spring coils and seals, however, are not limited to any specific value and there can be other instances with greater or smaller number of compression springs and seals. The compression spring 222 and seal 224 are configured to adjust the chamber 212 between the expanded state and the collapsed state. The expanded state of FIG. 2 corresponds to a restoration of pressure balance in the chamber 212 when a stream of fluid (clean oil), flowing out from the fluid reservoir (FIGS. 4 and 5), is received within the chamber 212.

The chamber 212 is coupled with an exemplary scraper blade 214 by a slideable sleeve 216. The sleeve 216, positioned on a tubular base of the chamber 212, is configured to engage the scraper blade 214 between a first, retracted position and a second, extended position (will be described in more details below, in FIG. 3). The sleeve is configured to move between the retracted position and the extended position through a reduction in pressure in the fluid in the fluid reservoir (described in more details, in relation to FIGS. 4 and 5). The scraper blade 214 is mounted on a leaf spring 226. Specifically, the leaf spring 226 is configured to operate in unison with the slideable sleeve 216 and to adjust the scraper blade 214 between the extended position and the retracted position. The expanded state of the chamber 212 corresponds to the retracted position of the scraper blade 214.

Referring to FIG. 2 again, the scraper blade 214 has an angled cross-section positioned within an accommodating, angled slot cut into a tubular base of the chamber 212. Further, the scraper blade 214 passes through a hole in the sleeve 216 and the hole has an angled cross-section. In operation, the angled cross-section of the scraper blade 214, the accommodating angle of the hole in the sleeve 216, and the accommodating angle of the slot in the tubular base of the chamber 212 work in unison to convert a left-right axial movement of the sleeve 216 into an up-down radial motion of the scraper blade 214. The leaf-spring 226 provided at the base of the scraper blade 214 biases the scraper blade 214 and keeps it loaded into the slot of the tubular base of the chamber 212 under right amount of pressure from the sleeve 216 mounted from above.

Figure 3:
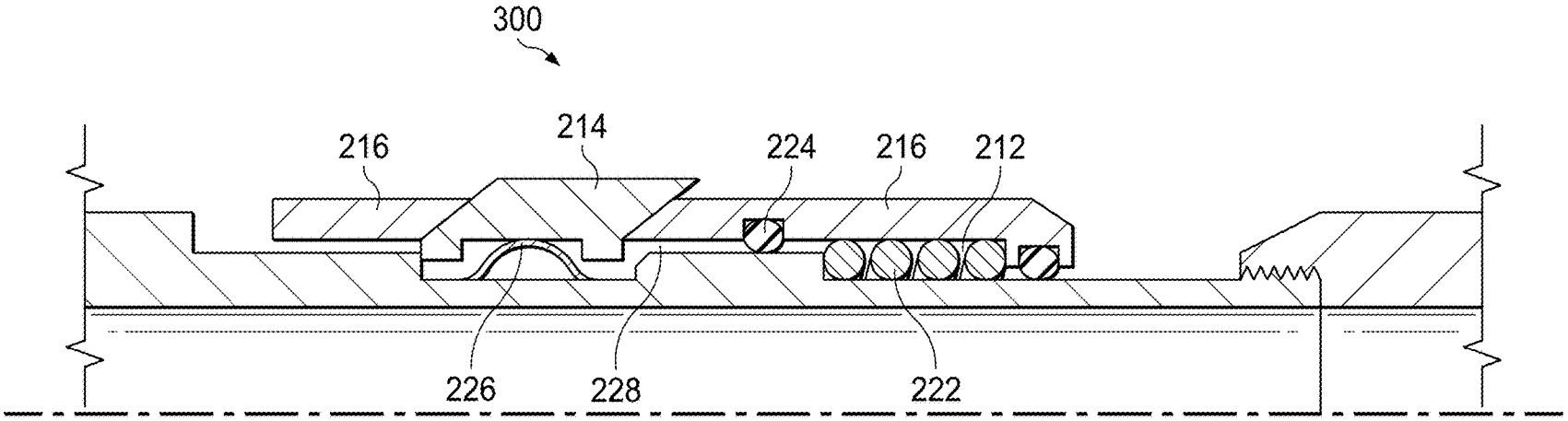
FIG. 3 illustrates a cross-sectional view of the chamber of the downhole cleaning tool of FIG. 1, in a collapsed state.

FIG. 3 is an illustrative cross-sectional view of the chamber 214 of FIG. 2 in an exemplary collapsed state and like numerals refer to like parts. Referring to FIG. 3, a scraping tool 300 includes a chamber 212 that is fluidly coupled to a fluid reservoir (will be described in more details later, in FIGS. 4 and 5) through a fluid communication line (FIGS. 4 and 5). The chamber 212 is configured to receive a stream of fluid (e.g., clean oil) flowing out from the fluid reservoir. The flow of the fluid (e.g., clean oil) into and out of the chamber 212 causes the chamber 212 to adjust, respectively, between an expanded state and a collapsed state by a mechanism described below.

The chamber 212 of FIG. 3 is in an exemplary collapsed state. The chamber 212 includes an exemplary compression spring 222, an exemplary seal 224, and a fluid communication line 228. The compression spring 222 and seal 224 are made of spring-steel or any other material suitable for engineering applications involving expansion and contraction of constituent parts. There are four coils in compression spring 222 and one seal 224 shown in FIG. 3. The number of compression spring coils and seals, however, are not limited to any specific value and there can be other instances with greater or smaller number of compression springs and seals. The compression spring 222 and seal 224 are configured to adjust the chamber 212 between the expanded state and the collapsed state. The collapsed state of FIG. 3 corresponds to a reduction of pressure in the chamber 212 when a part of the fluid (clean oil), received within the chamber 212 in the expanded state (FIG. 2), flows out of the chamber 212.

As described in the context of FIG. 2, the chamber 212 is coupled with an exemplary scraper blade 214 by a slideable sleeve 216. The sleeve 216, positioned on a tubular base of the chamber 212, is configured to engage the scraper blade 214 between a first, retracted position (FIG. 2) and a second, extended position (FIG. 3). The scraper blade 214 is mounted on a leaf spring 226. The leaf spring 226 is further configured to operate in unison with the slideable sleeve 216 to adjust the scraper blade 214 between the extended position and the retracted position. The collapsed state of the chamber 212 corresponds to the retracted position of the scraper blade 214.

Referring to FIG. 3, the scraper blade 214 has an angled cross-section positioned within an accommodating, angled slot cut into a tubular base of the chamber 212. Further, the scraper blade 214 passes through a hole in the sleeve 216 and the hole has an angled cross-section. In operation, the angled cross-section of the scraper blade 214, the accommodating angle of the hole in the sleeve 216, and the accommodating angle of the slot in the tubular base of the chamber 212 work in unison to convert a left-right axial movement of the sleeve 216 into an up-down radial motion of the scraper blade 214. The leaf-spring 226 provided at the base of the scraper blade 214 biases the scraper blade 214 and keeps it loaded into the slot of the tubular base of the chamber 212 under right amount of pressure from the sleeve 216 mounted from above.

FIG. 4 is an illustrative plumbing schematic of the downhole cleaning tool 400 (of FIGS. 1-3) for use in a wellbore. The tool includes a fluid reservoir 412 containing a volume of fluid (e.g., clean oil) 414 and a pressure wall 416 that defines and divides the fluid reservoir 412 into a first portion 418 and a second portion 422 opposite the first portion 418. In an embodiment, the pressure wall 416 may be a floating piston. The second portion 422 of the fluid reservoir 412 is fluidly coupled to ambient wellbore fluids. The floating piston 416 is configured to control an intake of the clean oil 414 into the fluid reservoir 412 and thereby to exert a force on the fluid (clean oil) and to maintain a predetermined oil pressure within the fluid reservoir 412. In one instance, the tool 400 includes a clean oil supply tank or container (not shown) fluidly coupled to the fluid reservoir 412, to supply the clean oil 414 to the fluid reservoir 412.

The tool 400 also includes a restrictor 432 fluidly coupled to the fluid reservoir 412. The restrictor 432 can be a flow restrictor or a pressure restrictor or any other type of orifice that is configured to control and to slow down an outflow of the clean oil 414 from the fluid reservoir 412, at a predetermined volume flow rate or at a predetermined amount of flow restriction. The restrictor 432 includes a tube 434 fluidly coupled to the fluid reservoir 412 and at least one orifice 436 fluidly coupled to the tube 434. The orifice 436 restricts flow of high pressure fluid from the first portion 418 of the fluid reservoir 412.

The tool 400 further includes an exemplary gas reservoir 442 fluidly coupled to the fluid reservoir 412 through the restrictor 432 and a fluid communication line 452. The gas reservoir 442 includes a control unit 444, a push pin 446, and a rupture disk 448. In one aspect, the tool 400 includes a controller 482. The gas reservoir 442 is controllable to open upon receiving a control signal 484 from the controller 482 and thereby to receive a first part of clean oil 414 flowing out from the fluid reservoir 412. The volume of the clean oil 414 in the fluid reservoir 412 is sufficient to fill the total volume of the gas reservoir 442 when operated to reduce the pressure.

The rupture disk 448 of the gas reservoir 442 is positioned adjacent the push pin 446 and the push pin 446 is configured to selectively rupture the rupture disk 448, thereby dropping the pressure of the fluid in the chamber 212. The control unit 444 is configured to initiate the push pin 446 upon receiving the control signal 484. In one instance, the control unit 444 include an explosive (such as thermite, as a non-limiting example) configured to explode upon receiving the control signal 484, and thereby to trigger the push from the push pin 446. In another instance, the flow to the gas reservoir 442 is regulated with an electrically activated valve such as a ball valve or a needle valve.

Referring to FIG. 4 again, the tool 400 further includes a chamber 212 (equivalent of chamber 212 of FIG. 2, shown in an expanded state and chamber 212 of FIG. 3, shown in a retracted state), an exemplary compression spring 222, an exemplary seal 224, and a fluid communication line 454. The compression spring 222 and seal 224 are made of spring-steel or any other material suitable for engineering applications involving expansion and contraction of constituent parts. There are four coils in the compression spring 222 and one seal 224 shown in FIG. 4. The number of coils in the compression spring and seals, however, are not limited to any specific value and there can be other instances with greater or smaller number of compression springs and seals. In one instance, the spring is a series of Belville washers or a wave spring.

The chamber 212 is fluidly coupled to the fluid reservoir 412 through the fluid communication line 454. The chamber 412 is configured to receive a part of the clean oil 414 flowing out from the first portion 418 of the fluid reservoir 412. The flow of the fluid (e.g., clean oil) into and out of the chamber 212 causes the chamber 212 to adjust, respectively, between an expanded state (as in FIG. 2) and a collapsed state (as in FIG. 3) by a mechanism described below. The collapsed state of the chamber 212 corresponds to a reduction in pressure in the chamber 212 caused by the burst of the gas reservoir 442. The expanded state of the chamber 212 corresponds to a restoration of pressure balance in the chamber 212 caused by a part of the second part of the outflow of the clean oil from the fluid reservoir 412 received into the chamber 212. The first fluid in the fluid reservoir is at a pressure higher than the pressure of the fluid in the chamber, and the pressure of the first fluid is about equal to a pressure of ambient wellbore fluids.

The chamber 212 of FIG. 4 is in an exemplary expanded state. The compression spring 222 and seal 224 are configured to adjust the chamber 212 between the expanded state and the collapsed state. The chamber 212 is coupled with an exemplary scraper blade 214 by a slideable sleeve 216. Further, the scraper blade 214 is mounted on a leaf spring 226. The leaf spring 226 is configured to operate in unison with the slideable sleeve 216 to engage the scraper blade 214 between a first, retracted position (as in FIG. 2) and a second, extended position (as in FIG. 3). When the chamber 212 is in its expanded state, the scraper blade 214 is moved to its retracted position. Conversely, when the chamber 212 is in its collapsed state, the scraper blade 214 is moved to its extended position. In other instances, the leaf spring 226 is replaced with another spring or is not used.

Referring to FIG. 4 once more, the scraper blade 214 has an angled cross-section positioned within an accommodating, angled slot cut into a tubular base of the chamber 212. Further, the scraper blade 214 passes through a hole in the sleeve 216 and the hole has an angled cross-section. In operation, the angled cross-section of the scraper blade 214, the accommodating angle of the hole in the sleeve 216, and the accommodating angle of the slot in the tubular base of the chamber 212 work in unison to convert a left-right axial movement of the sleeve 216 into an up-down radial motion of the scraper blade 214. The leaf-spring 226 provided at the base of the scraper blade 214 biases the scraper blade 214 and keeps it loaded into the slot of the tubular base of the chamber 212 under right amount of pressure from the sleeve 216 mounted from above. The compression spring 222 is positioned in the chamber 212 to bias the scraper blade 214 to the retracted position. The leaf spring 226 is positioned beneath the scraper blade 214 to bias the scraper blade toward the extended position.

The scraper blade 214 is configured to operate through a scraping time and to clean the wellbore (102 of FIG. 1). The scraping time represents the time that the scraper blade remains in the extended position and is determined based at least in part on a size of the orifice 436 and a size of the restrictor 432. The scraping time is the time interval before the chamber 212 regains its expanded state and causes the scraper blade 214 to retract back. The scraping time of the scraper blade 214 is adjusted based on a size and number of the restrictor 432, a size and number of orifices 436, a viscosity and density of the clean oil 414, and size of the gas reservoir 442.

The tool 400 further includes fluid communication lines 452 and 454 coupled to the fluid reservoir 412 through the restrictor 432. The fluid communication line 452 is configured to transport a first part of the outflow of the clean oil 414 from the fluid reservoir 412 to the gas reservoir 442 upon the burst (or open) of any of the gas reservoir 442. The fluid communication line 454 is configured to transport a second part of the outflow of the clean oil 414 from the fluid reservoir 412 to the chamber 212 upon the burst of any of the gas reservoir 442.

In one aspect, the tool further includes a controller 482 configured to transmit a control signal 484, as mentioned above. The control signal 484 may be one or more of a pressure pulse, a mechanical manipulation of the tool, a rotation of the tool, and an acoustic signal.

The rupture of the gas reservoir 442 on receipt of the control signal 484 from the controller 482 sets in motion a pressure-actuated collapsing motion of the chamber 412, and a resulting extending motion of the scraper blade 416. This mechanism of hydrostatic pressure balancing, initiated by a controlled burst (or opening) of a gas reservoir 442, is commonly known as "armada trigger", as explained below.

The gas reservoir 442, with its contents, is typically sealed at a ground-level atmospheric pressure of about 14.5 pounds per square inch (psi), before it is installed into the scraping tool 400. Therefore, at the time of a burst of the rupture disk 448, the pressure inside the gas reservoir 442 is typically around 14.5 pound per square inch (psi). The fluid reservoir 412 and in the chamber 212, however, are maintained at ambient wellbore fluids pressure at the depth of the wellbore, amounting to several thousands of psi (e.g., 5000 psi, as a non-limiting instance). In other words, the pressure inside the gas reservoir 442 is about 14.5 psi and the pressure outside the gas reservoir 442 is about 5000 psi. Consequently, on the burst of the rupture disk 448, fluid from the fluid reservoir 412 and from the chamber 212 rushes in to fill the void inside the gas reservoir 442. The sudden flow of the fluid out of the chamber 212 causes the chamber 212 to collapse, pushing the sleeve 216 to the left, and extending the blade 214 outward.

The extension of the blade 214 outward causes it to reach the inside of the casing wall. The scraping tool 400 is rotated at this point of time, causing the scraping blade 214 to begin a scraping action. With time, a replenishing supply of fluid flows from the fluid reservoir 412 into the chamber 212 and slowly fills the chamber 212. As the chamber 212 begins to refill, fluid pressure inside the chamber 212 is restored causing it to expand at a controlled rate. The expansion of the chamber 212 pushes the sleeve 216 to the right and retracts the blade 214 inward, withdrawing it from its scraping action, at a controlled rate.

In operation, this is an on-demand, location-specific or zone-specific, timer-based scraping tool. Typically, a wireless or telemetry-based command signal 484 is sent from the controller 482 to activate the scraper blade 214. The blade 214 extends out and begins scraping the inside wall of the casing over a specific location or a specific zone of interest. The scraping tool 400 then rotates and goes up or down or stops, as necessary, for the duration of the scraping operation. After the passage of a pre-timed interval, as measured from the beginning of the trigger signal, the blade 214 is retracted into its default position. The tool 400 can then be moved further up or down or stop, and a new trigger can be initiated by the control signal 484 to rerun the scraping cycle again. The scraping time is controlled by actuating the restrictor 432 and other flow parameters associated with the restrictor 432. The blade 214 is retracted after the expiry of the scraping time. In essence, a flow of higher pressure fluid to the chamber 212 is regulated, and the sleeve 216 is moved to retract the scraper blade 214 in response to the increased pressure of the fluid in the chamber 212. The retraction of the scraper blade 214 is selectively timed based on the restriction of the flow of the higher pressure fluid from the fluid reservoir.

FIG. 5 is an illustrative detailed, alternative plumbing schematic of a downhole cleaning tool of FIG. 4 and like numerals refer to like parts. Referring to FIG. 5, a plumbing schematic of wellbore cleaning tool 500 includes a fluid reservoir 412, clean oil 414 and a floating piston 416. The floating piston 416 defines and divides the fluid reservoir 412 into a first portion 418 and a second portion 422 opposite the first portion 418. The second portion 422 of the fluid reservoir 412 is in communication with ambient wellbore fluids. The floating piston 416 is configured to control an intake of the clean oil 414 into the fluid reservoir 412 and thereby to exert a force on the fluid (clean oil) and to maintain a predetermined oil pressure within the fluid reservoir 412. In one instance, the tool 400 includes a clean oil supply tank or container (not shown) fluidly coupled to the fluid reservoir 412 and configured to supply the clean oil 414 to the fluid reservoir 412.

The tool 500 also includes a restrictor 432 fluidly coupled to the fluid reservoir 412. The restrictor 432 can be a flow restrictor or a pressure restrictor or an orifice that is configured to control and to slow down an outflow of the clean oil 414 from the fluid reservoir 412, at a predetermined volume flow rate or at a predetermined amount of flow restriction. The restrictor 432 includes a tube 434 fluidly coupled to the fluid reservoir 412 and at least one orifice 436 fluidly coupled to the tube 434.

Referring to FIG. 5, there are three exemplary gas reservoirs 442 and each of the gas reservoirs 442 includes a control unit 444, a push pin 446, and a rupture disk 448. There are fluid communications lines 452 to the gas reservoirs 442. Further, there is a fluid communication line 454 to a chamber (not shown).

The structure and operation of the system in FIG. 5 is similar to the system in FIG. 4 except for the fact that there are three exemplary gas reservoirs shown, instead of one. Accordingly, the collapse and expansion of the chamber, and consequently the extension and retraction of the scraper blade can be executed over up to three times. The number of gas reservoirs is not limited to one or three and there can be other instances with greater or smaller number of gas reservoirs.

Referring back to FIG. 5, a scraping time of the scraper blade (214 of FIG. 4) is adjusted based on a size and number of the restrictor 432, a size and number of orifices 436, a viscosity and density of the clean oil 414, and size of the gas reservoir 442.

It is to be understood that the controllable downhole scraper tool (106 of FIGS. 1, 200 of FIG. 2, 300 of FIG. 3, 400 of FIG. 4, and 500 of FIG. 5) and its components as depicted in FIGS. 1-5 are only one possible configuration of the controllable downhole scraper (108 of FIG. 1, and 214 of FIGS. 2 to 4). As such, it is to be recognized that the illustrated controllable downhole scraper is merely exemplary in nature, and various additional configurations may be used that have not necessarily been depicted in FIGS. 1-5 in the interest of clarity. Moreover, non-limiting additional components may be present, including, but not limited to, valves, condensers, adapters, joints, gauges, sensors, compressors, pressure controllers, pressure sensors, flow rate controllers, flow rate sensors, temperature sensors, and the like. As such, it should be clearly understood that the examples illustrated by FIGS. 1-5 are merely a general application of the principles of this disclosure in practice, and a wide variety of other examples are possible. Therefore, the scope of this disclosure is not limited in any manner to the details of FIGS. 1-5 as described herein.

It is to be recognized that the controllable downhole scraper may also directly or indirectly affect the various downhole equipment and tools that may contact the controllable downhole scraper disclosed herein. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the apparatus, methods, and systems generally described above and depicted in FIGS. 1-5.

Provided is a method for cleaning a wellbore. An example method comprises the steps of selectively opening a gas reservoir to reduce a pressure of a fluid in a chamber adjacent a sleeve, moving the sleeve to extend a scraper blade in response to the reduction in pressure of the fluid, and cleaning the wellbore with the extended scraper blade.

Additionally or alternatively, the method may include one or more of the following features individually or in combination.

The method may further include increasing the pressure of the fluid in the chamber to move the sleeve and retract the scraper blade.

The method may further include providing a fluid reservoir fluidly coupled to the chamber, and restricting a flow of a first fluid from the fluid reservoir to the chamber.

The first fluid in the fluid reservoir is at a pressure higher than the pressure of the fluid in the chamber, and the pressure of the first fluid is about equal to a pressure of ambient wellbore fluids.

The method may further include providing a controller and configuring the controller to transmit a control signal and open the gas reservoir, the control signal comprising at least one of a pressure pulse, a mechanical manipulation of the tool, a rotation of the tool, and an acoustic signal.

The method may further include operating a push pin, and rupturing a disk to open the gas reservoir.

The method may further include providing a control unit within the gas reservoir, and initiating the operation of the push pin upon the control unit receiving the control signal.

The method may further include regulating a flow of higher pressure fluid to the chamber, and moving the sleeve to retract the scraper blade in response to the increased pressure of the fluid in the chamber.

The method may further include restricting a flow of the higher pressure fluid from a fluid reservoir.

The retraction of the scraper blade is selectively timed based on the restriction of the flow of the higher pressure fluid from the fluid reservoir.

Provided is a controllable downhole scraper for removing debris from an inner surface of a wellbore casing. An example controllable downhole scraper comprises a fluid reservoir having a piston positioned and movable within the fluid reservoir to define a first portion of the fluid reservoir that includes a first fluid, the piston exerting a force on the first fluid to maintain a first pressure. The controllable downhole scraper also includes a scraper blade movable between a retracted position and an extended position. The controllable downhole scraper further includes a sleeve positioned on a tubular and slidable between a first position and a second position. Advantageously, the sleeve in the first position engages the scraper blade to move the scraper blade into the retracted position. Conversely, the sleeve in the second position engages the scraper blade to move the scraper blade into the extended position. The sleeve is configured to move between the retracted position and the extended position through a reduction in the first pressure in the first fluid. A restrictor is fluidly coupled between the fluid reservoir and a pressure reservoir. The restrictor comprises a tube fluidly coupled to the first portion of the fluid reservoir and at least one orifice fluidly coupled to the tube. A gas reservoir is fluidly coupled to the first fluid. The gas reservoir is selectively operable to reduce the first pressure in the first fluid.

Additionally or alternatively, the controllable downhole scraper may include one or more of the following features individually or in combination.

The fluid reservoir includes a second portion opposite the first portion of the fluid reservoir, the second portion of the fluid reservoir in communication with ambient wellbore fluids.

A controller is configured to transmit a control signal configured to operate the gas reservoir, the control signal comprising at least one of a pressure pulse, a mechanical manipulation of the tool, a rotation of the tool, and an acoustic signal.

The gas reservoir includes a push pin, and a rupture disk, the rupture disk positioned adjacent the push pin, the push pin configured to selectively rupture the rupture disk, thereby reducing the first pressure in the first fluid.

The controllable downhole scraper further includes a control unit, the control unit configured to initiate the push pin upon receiving the control signal.

The gas reservoir is controllable to open upon receiving a control signal and thereby to receive a first portion of the first fluid from the fluid reservoir. In one aspect, the pressure reservoir includes a chamber defined between the sleeve and the tubular. The chamber is fluidly coupled to the first portion of the fluid reservoir and configured to receive a part of a second portion of the first fluid from the fluid reservoir. The chamber being adjustable between an expanded state and a collapsed state, the collapsed state corresponding to a reduction of pressure in the chamber caused by a burst of the gas reservoir, the expanded state corresponding to a restoration of pressure in the chamber caused by a part of the second part of the first fluid received in the chamber, the collapsed state further corresponding to the extended position of the scraper blade, and the expanded state further corresponding to the retracted position of the scraper blade.

The controllable downhole scraper includes a compression spring positioned in the chamber to bias the scraper blade to the retracted position.

The controllable downhole scraper includes a leaf spring positioned beneath the scraper blade to bias the scraper blade toward the extended position.

The restrictor includes an orifice that restricts fluid flow from the first portion of the fluid reservoir. A scraping time representing the time that the scraper blade remains in the extended position is determined based at least in part on a size of the orifice. The volume of the first fluid is sufficient to fill the gas reservoir when operated to reduce the pressure.

Although some embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims.

What is claimed is:

1. A controllable downhole scraper comprising:

a fluid reservoir having a pressure wall positioned and movable within the fluid reservoir to define a first portion of the fluid reservoir that includes a first fluid, the pressure wall exerting a force on the first fluid to maintain a first pressure;

a scraper blade movable between a retracted position and an extended position;

a sleeve positioned on a tubular and slidable between a first position and a second position, the sleeve in the first position engaging the scraper blade to move the scraper blade into the retracted position, the sleeve in the second position engaging the scraper blade to move the scraper blade into the extended position, wherein the sleeve is configured to move between the retracted position and the extended position through a reduction in the first pressure of the first fluid;

a restrictor fluidly coupled between the fluid reservoir and a pressure reservoir; and a gas reservoir selectively operable to reduce the first pressure of the first fluid.

2. The controllable downhole scraper of claim 1, wherein the restrictor comprises an orifice that restricts fluid flow from the first portion of the fluid reservoir, and a scraping time representing the time that the scraper blade remains in the extended position is determined based at least in part on a size of the orifice.

3. The controllable downhole scraper of claim 1, wherein the volume of the first fluid is sufficient to fill the gas reservoir when operated to reduce the pressure.

4. The controllable downhole scraper of claim 1, wherein the fluid reservoir comprises a second portion opposite the first portion of the fluid reservoir, the second portion of the fluid reservoir in communication with ambient wellbore fluids.

5. The controllable downhole scraper of claim 1 further comprising a controller configured to transmit a control signal configured to operate the gas reservoir, the control signal comprising at least one of a pressure pulse, a mechanical manipulation of the downhole scraper, a rotation of the downhole scraper, and an acoustic signal.

6. The controllable downhole scraper of claim 5, wherein the gas reservoir comprises a push pin, and a rupture disk, the rupture disk positioned adjacent the push pin, the push pin configured to selectively rupture the rupture disk, thereby reducing the first pressure in the first fluid.

7. The controllable downhole scraper of claim 6, wherein the gas reservoir further comprises a control unit, the control unit configured to initiate the push pin upon receiving the control signal.

8. The controllable downhole scraper of claim 7, wherein:

the gas reservoir is controllable to open upon receiving the control signal and thereby to receive a first portion of the first fluid from the fluid reservoir, and the pressure reservoir comprises a chamber defined between the sleeve and the tubular, the chamber fluidly coupled to the first portion of the fluid reservoir, the chamber configured to receive a part of a second portion of the first fluid from the fluid reservoir, the chamber being adjustable between an expanded state and a collapsed state, the collapsed state corresponding to a reduction of pressure in the chamber caused by a burst of the gas reservoir, the expanded state corresponding to a restoration of pressure in the chamber caused by a part of the second part of the first fluid received in the chamber, the collapsed state further corresponding to the extended position of the scraper blade, and the expanded state further corresponding to the retracted position of the scraper blade.

9. The controllable downhole scraper of claim 8 further comprising a compression spring positioned in the chamber to bias the scraper blade to the retracted position.

10. The controllable downhole scraper of claim 8 further comprising a leaf spring positioned beneath the scraper blade to bias the scraper blade toward the extended position.

11. A method of cleaning a wellbore with a downhole scraper, the method comprising the steps of:

selectively opening a gas reservoir to reduce a pressure of a fluid in a chamber adjacent a sleeve;

moving the sleeve to extend a scraper blade in response to the reduction in pressure of the fluid; and cleaning the wellbore with the extended scraper blade.

12. The method of claim 11 further comprising:

increasing the pressure of the fluid in the chamber to move the sleeve and retract the scraper blade.

13. The method of claim 12, wherein increasing the pressure further comprises:

providing a fluid reservoir fluidly coupled to the chamber; and restricting a flow of a first fluid from the fluid reservoir to the chamber.

14. The method of claim 13, wherein:

the first fluid in the fluid reservoir is at a pressure higher than the pressure of the fluid in the chamber; and the pressure of the first fluid is about equal to a pressure of ambient wellbore fluids.

15. The method of claim 11 further comprising providing a controller and configuring the controller to transmit a control signal and open the gas reservoir, the control signal comprising at least one of a pressure pulse, a mechanical manipulation of the downhole scraper, a rotation of the downhole scraper, and an acoustic signal.

16. The method of claim 15, wherein selectively opening the gas reservoir comprises:

operating a push pin; and rupturing a disk to open the gas reservoir.

17. The method of claim 16, wherein selectively opening the gas reservoir comprises:

providing a control unit within the gas reservoir; and initiating the operation of the push pin upon the control unit receiving the control signal.

18. The method of claim 11 further comprising:

regulating a flow of higher pressure fluid to the chamber; and moving the sleeve to retract the scraper blade in response to the increased pressure of the fluid in the chamber.

19. The method of claim 18, wherein regulating a flow further comprises:

restricting a flow of the higher pressure fluid from a fluid reservoir.

20. The method of claim 19, wherein the retraction of the scraper blade is selectively timed based on the restriction of the flow of the higher pressure fluid from the fluid reservoir.

* * * * *